US009934712B2

(12) United States Patent
Lee

(10) Patent No.: US 9,934,712 B2
(45) Date of Patent: Apr. 3, 2018

(54) DISPLAY, TIMING CONTROLLER AND COLUMN DRIVER INTEGRATED CIRCUIT USING CLOCK EMBEDDED MULTI-LEVEL SIGNALING

(75) Inventor: Yong-Jae Lee, Yongin-si (KR)

(73) Assignee: ANAPASS INC., Seoul (KR)

( * ) Notice: Subject to any disclaimer, the term of this patent is extended or adjusted under 35 U.S.C. 154(b) by 1801 days.

(21) Appl. No.: 12/066,553

(22) PCT Filed: Nov. 10, 2005

(86) PCT No.: PCT/KR2005/003678

§ 371 (c)(1),
(2), (4) Date: Mar. 12, 2008

(87) PCT Pub. No.: WO2007/035014

PCT Pub. Date: Mar. 29, 2017

(65) Prior Publication Data

US 2008/0246752 A1 Oct. 9, 2008

(30) Foreign Application Priority Data

Sep. 23, 2005 (KR) ..... 10-2005-0088619

(51) Int. Cl.
*G09G 3/20* (2006.01)
*G09G 3/36* (2006.01)

(52) U.S. Cl.
CPC ..... *G09G 3/20* (2013.01); *G09G 3/3611* (2013.01); *G09G 2300/0426* (2013.01);
(Continued)

(58) Field of Classification Search
CPC .... G09G 3/20; G09G 3/3611; G09G 2330/06; G09G 2310/027; G09G 2310/08; G09G 2300/0426
See application file for complete search history.

(56) References Cited

U.S. PATENT DOCUMENTS 4,809,090 A * 2/1989 Suzuki ..... 360/46
5,416,484 A * 5/1995 Lofstrom ..... 341/159
(Continued)

FOREIGN PATENT DOCUMENTS

EP 420281 A2 4/1991
JP 1995-212690 A2 8/1995
(Continued)

*Primary Examiner* — Patrick Edouard
*Assistant Examiner* — Joseph Fox
(74) *Attorney, Agent, or Firm* — Paratus Law Group, PLLC

(57) ABSTRACT

The present invention relates to a display, a timing controller and a column driver IC, and more particularly to a display, timing controller and column driver integrated circuit using clock embedded multi-level signaling. The present invention provides a timing controller including a transmitter for transmitting a transmission signal wherein a transmission clock signal is embedded therein between a transmission data signal to have a signal magnitude different from that of the transmission data signal. The present invention also provides a column driver integrated circuit including a receiving unit for separating a clock signal from a received signal using a magnitude of the received signal, and for performing a sampling of a received data signal from the received signal using the separated clock signal.

11 Claims, 7 Drawing Sheets

(52) U.S. Cl.
CPC ... *G09G 2310/027* (2013.01); *G09G 2310/08* (2013.01); *G09G 2330/06* (2013.01); *G09G 2370/08* (2013.01); *G09G 2370/14* (2013.01)

(56) References Cited

U.S. PATENT DOCUMENTS 5,902,180 A * 5/1999 Sunaga ..... B60H 1/00978 454/121
6,215,467 B1 4/2001 Suga et al.
6,236,393 B1 * 5/2001 Ogawa ..... G09G 3/3688 345/204
6,724,430 B2 4/2004 Miyoshi et al.
6,816,139 B2 * 11/2004 Park ..... G09G 5/005 345/3.1
2002/0175805 A9 * 11/2002 Armstrong et al. ..... 340/10.31
2003/0006997 A1 * 1/2003 Ogawa et al. ..... 345/690
2003/0184511 A1 10/2003 Sekido et al.
2004/0160402 A1 8/2004 Kim et al.
2004/0257350 A1 * 12/2004 Kobayashi ..... 345/204

FOREIGN PATENT DOCUMENTS

JP 1995-261718 A2 10/1995
JP 1996-297477 A2 11/1996
JP 1999-282407 A2 10/1999
JP 2001-346225 A2 12/2001
JP 2003-295836 A 10/2003
JP 2004-240428 A 8/2004
KR 10-0202171 B1 3/1999
KR 10-0221476 B1 6/1999

* cited by examiner

[Fig. 1]
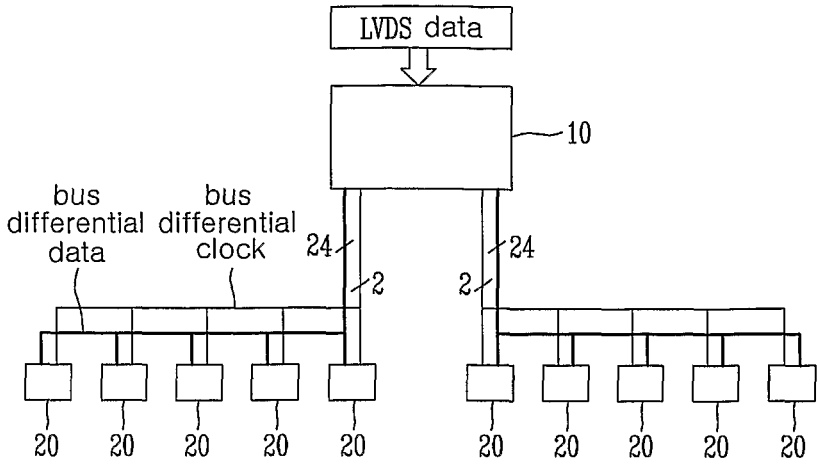
[Fig. 2]
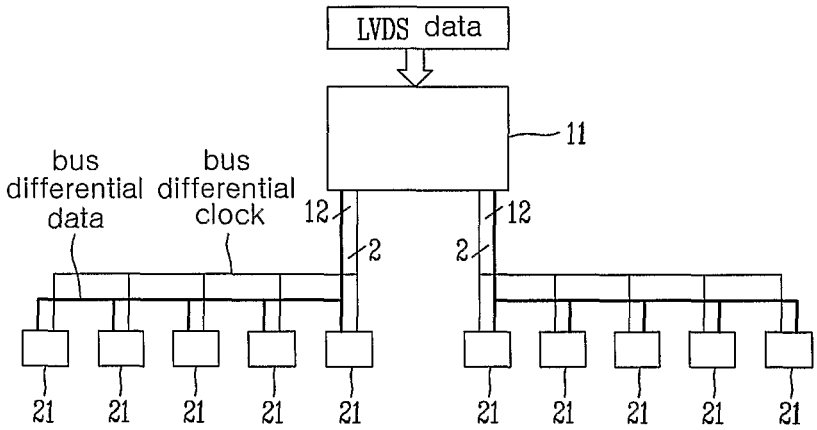
[Fig. 3]
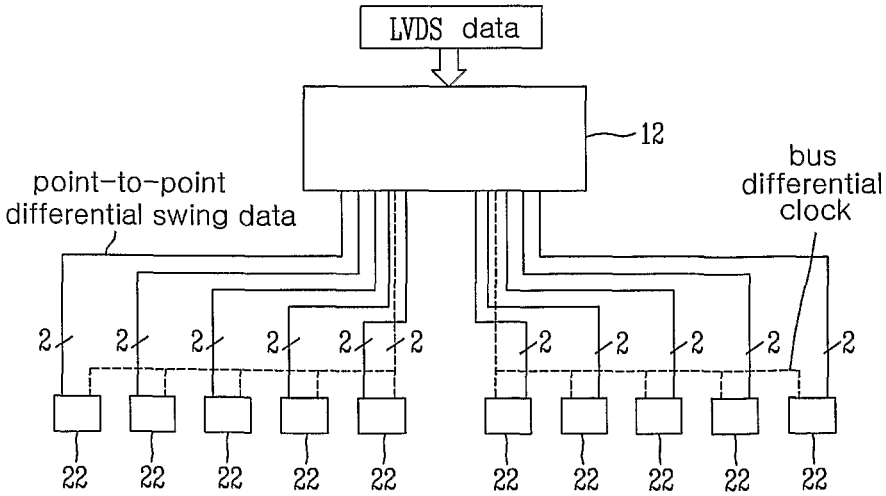

[Fig. 4]
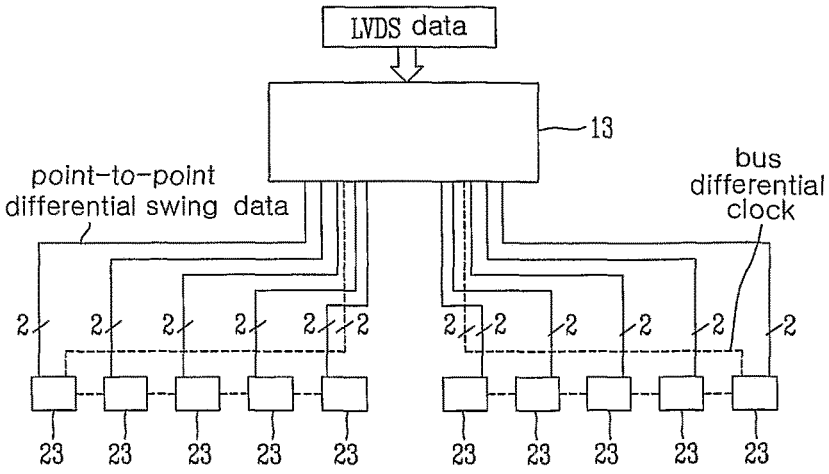
[Fig. 5]
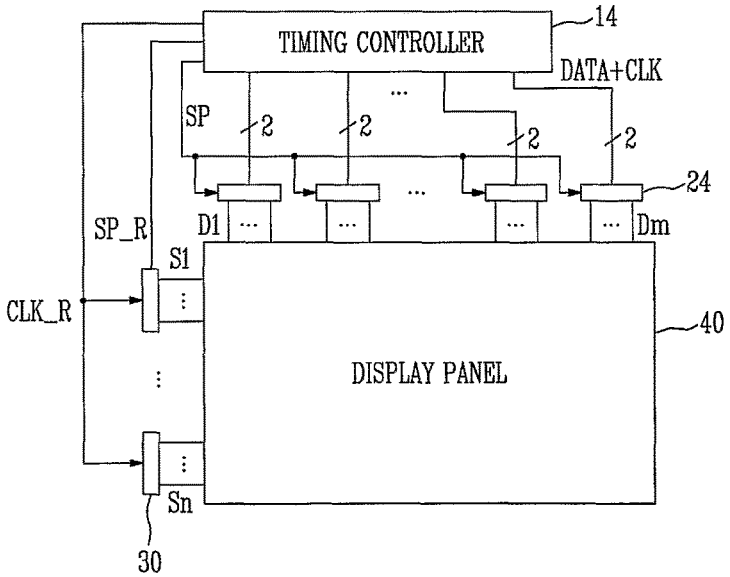
[Fig. 6]
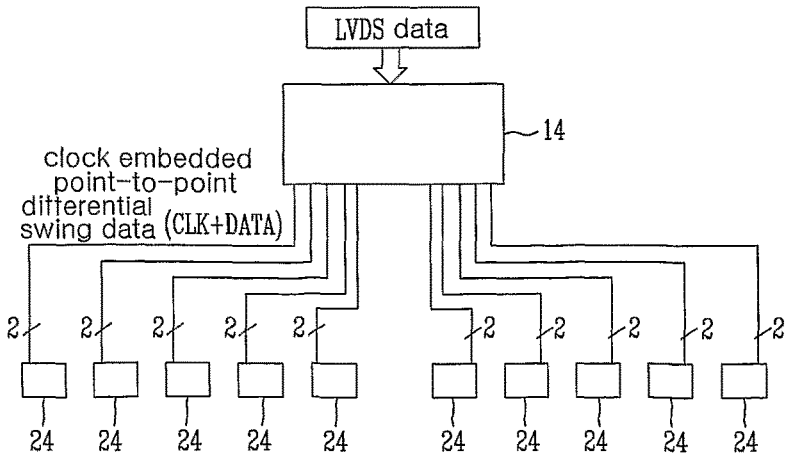

[Fig. 7]
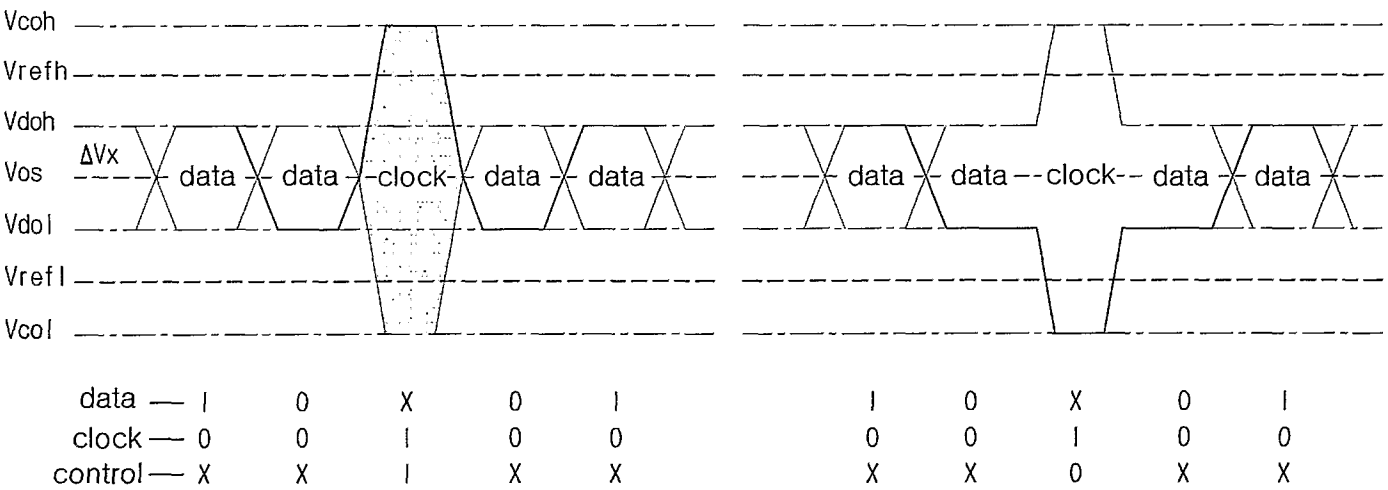

[Fig. 8]
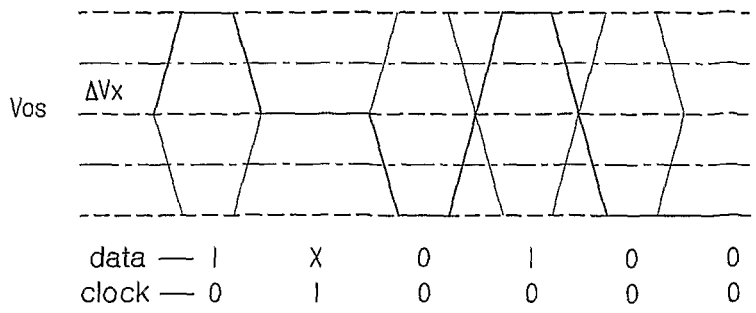
[Fig. 9]
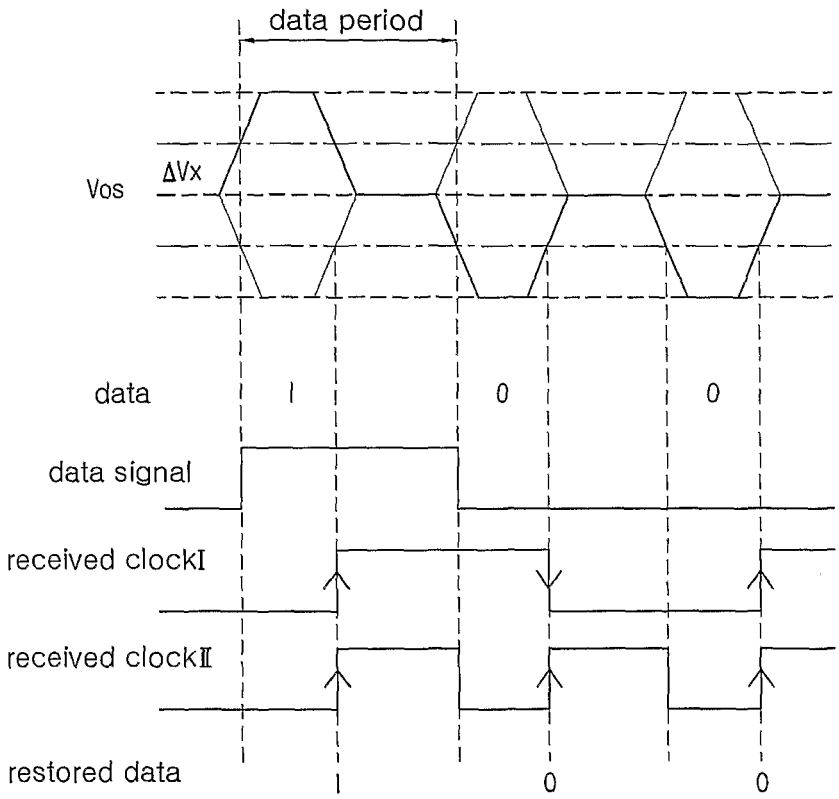
[Fig. 10]
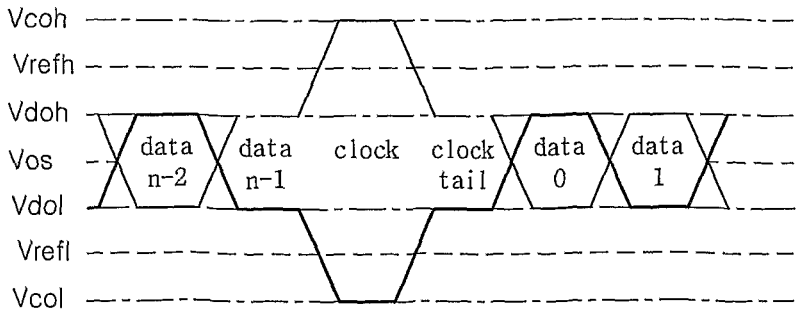

[Fig. 11]
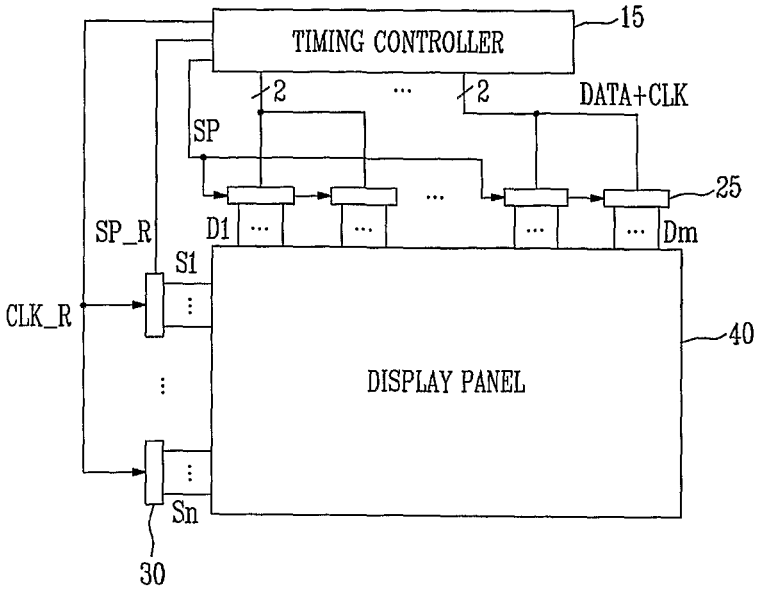
[Fig. 12]
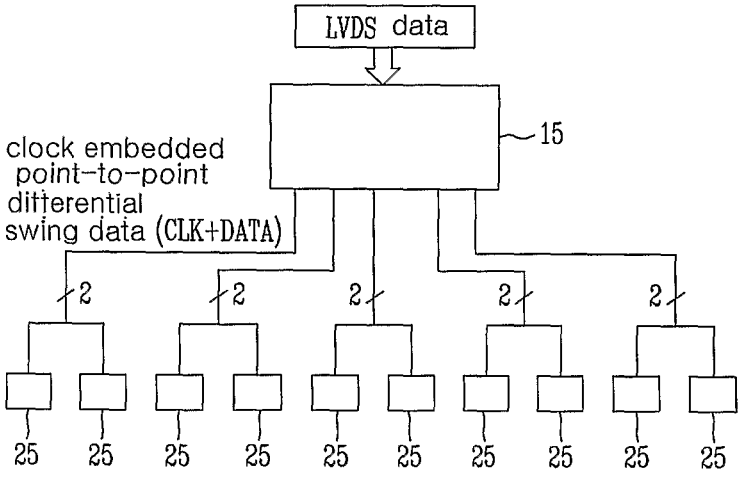

[Fig. 13]
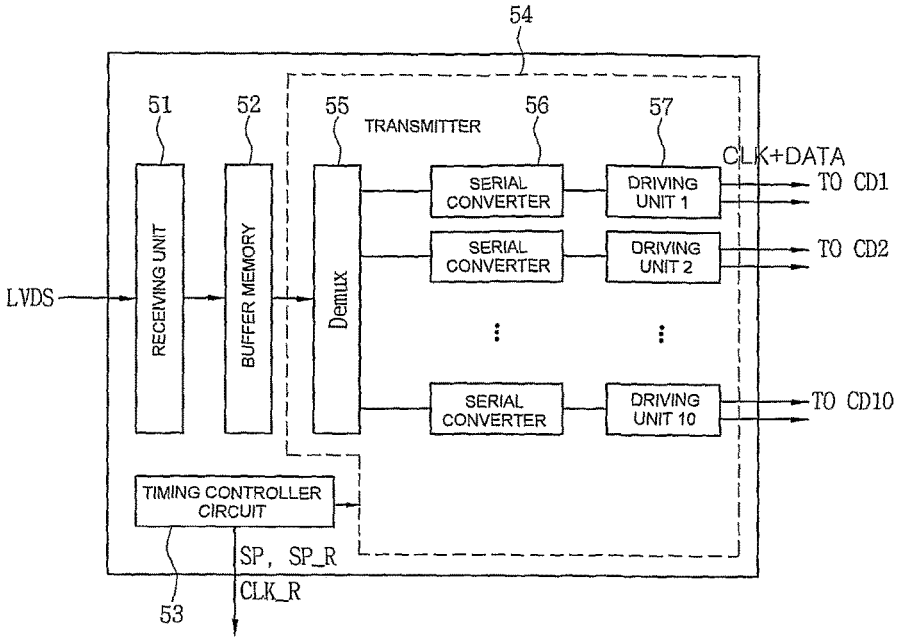
[Fig. 14]
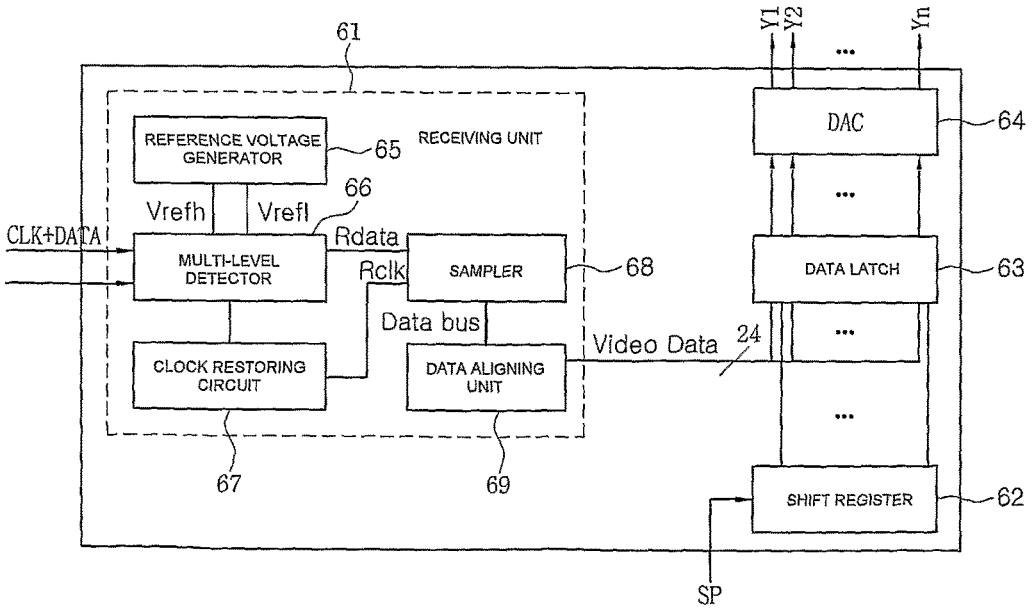

[Fig. 15]
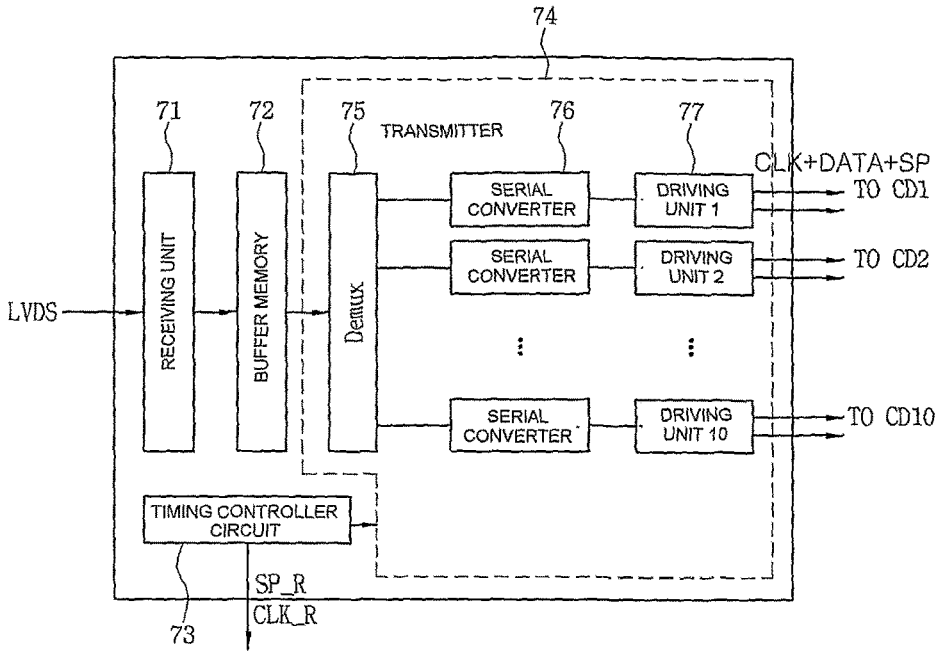
[Fig. 16]
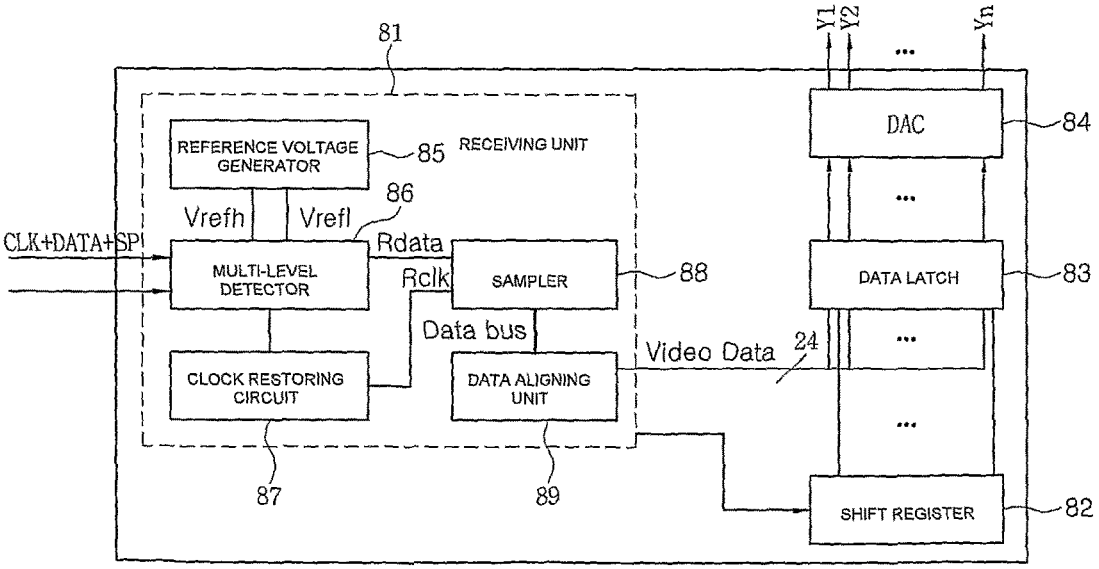

DISPLAY, TIMING CONTROLLER AND COLUMN DRIVER INTEGRATED CIRCUIT USING CLOCK EMBEDDED MULTI-LEVEL SIGNALING

TECHNICAL FIELD

The present invention relates to a display, a timing controller and a column driver IC (integrated circuit), and more particularly to a display, timing controller and column driver IC using clock embedded multi-level signaling.

BACKGROUND ART

Recently, in addition to an increase in a popularization of portable electronic devices such as a notebook computer and a personal portable communication device, a market size of digital appliances and personal computers is constantly increased. Display apparatuses which are final connection medium between such devices and users is required to have a light weight and low power consumption. Therefore, FPDs (Flat Panel Displays) such as an LCD (Liquid Crystal Display), a PDP (Plasma Display Panel) and an OELD (Organic Electro-Luminescence Display) are generally used instead of a conventional CRT (Cathode Ray Tube).

DISCLOSURE OF INVENTION

Technical Problem

As described above, in case of generalized FPD system, a timing controller and a driver IC for driving panel (scan driver integrated circuit and column driver integrated circuit) are required for driving a panel that is used for display. However, a large amount of a problematic wave interference caused in an electronic device by an electromagnetic wave and a radio frequency wave so-called an EMI (electromagnetic interference) or an RFI (radio frequency interference) (hereinafter commonly referred to as "EMI") is generated in a line for transmitting a data signal between the timing controller and the driver IC for driving panel.

Moreover, in case of current FPD system, a large screen and a high resolution are constantly pursued, and in case of a high resolution panel in particular, since the number of a column line is from a few hundreds to two thousand, an input to the column driver integrated circuit for driving each of these lines requires a high speed data transmission technology.

As described above, since an EMI standard is reinforced recently, and a technology for transmitting a signal in a high speed is far more required, a small signal differential signaling method such as an RSDS (Reduced Swing Differential Signaling) or a mini-LVDS is commonly used in an intra-panel display for connecting the timing controller and the panel resultantly.

FIG. 1 is a schematic diagram illustrating an embodiment of a conventional RSDS (Reduced Swing Differential Signaling), and FIG. 2 is a schematic diagram illustrating an embodiment of a conventional mini-LVDS (Low Voltage Differential Signaling). The RSDS and mini-LVDS both comprise one or more data signal lines to meet a required bandwidth using a separate clock signal synchronized to a data. Since only one clock signal is used, the clock signal and the data signals must be provided to match the number of the column driver integrated circuits 20 and 21 inside the panel. That is, as shown in FIGS. 1 and 2, the RSDS and the mini-LVDS both employ a multi-drop method.

However, the multi-drop method employed by both the RSDS and the mini-LVDS is disadvantageous in that a maximum operating speed is limited due to a large load of the clock signal as well as an increase in EMI and degradation of quality of the signal such as a signal distortion due to impedance mismatch at a point where lines are split.

An intra-panel interface employing a point-to-point method recently announced by National Semiconductor Corporation is a PPDS (Point-to-Point Differential Signaling). In accordance with this method shown in FIG. 3, clock signals are transmitted to each of column driver integrated circuits 22 to solve a problem that occurs when the clock signal is shared by the column driver integrated circuit 22. Moreover, this method is characterized in that an independent data line is disposed between a timing controller and a single column driver integrated circuit 22 while a plurality of data lines are connected to a plurality of column driver integrated circuits conventionally. That is, as a serial method is employed to the PPDS as shown in FIG. 3, a single independent data line is disposed from a PPDS timing controller 12 toward the single column driver integrated circuit 22.

Therefore, the impedance mismatch is reduced compared to the conventional multi-drop method employed by the RSDS and the mini-LVDS so that EMI is reduced and a low manufacturing cost is achieved by reducing the number of total signal line.

However, a higher speed clock signal compared to the conventional RSDS is required, and separate clock lines are connected to all of the column driver integrated circuit respectively so that an overhead exists. Moreover, when a skew between a clock signal for sampling data and a data signal exists, an error may occur during a data sampling process. In order to prevent this, a separate circuit for compensating the skew is necessary. Therefore, the PPDS has problems different from the conventional RSDS and the mini-LVDS that should be solved.

In addition, as shown in FIG. 4, a configuration wherein a column driver integrated circuit 23 receives a clock signal in a chain form has been recently proposed. Such configuration is advantageous in that an impedance mismatch due to a multi-drop of a clock line and a resulting EMI can be reduced. However, this configuration is problematic that a data sampling is failed due to a delay of a clock occurring between the column driver integrated circuit 23.

As described above, the latest trend in the intra-panel interface is focused on reducing the number of signal lines and EMI component. In addition, an operating speed and a resolution of a panel are increased compared with the reduction of the number of signal lines so that a novel intra-panel interface that can solve problems such as the skew and the relative jitter occurring daring a high speed signal transmission process is required.

Technical Solution

It is an object of the present invention to provide a display, a timing controller and a column driver integrated circuit wherein the number of the signal lines is remarkably reduced, the EMI is also reduced and the accurate sampling is possible using the restored clock.

In accordance with first aspect of the present invention, there is provided a timing controller comprising: a receiving unit for receiving an image data; a buffer memory for temporarily storing and outputting the received image data; a timing controller circuit for generating a transmission clock signal; and a transmitter for receiving the transmission clock signal and a transmission data signal including the image data output by the buffer memory, and for transmitting a transmission signal wherein the transmission clock signal is embedded therein between the transmission data signal to have a signal magnitude different from that of the transmission data signal.

In accordance with second aspect of the present invention, there is provided a column driver integrated circuit, comprising: a receiving unit for separating a clock signal from a received signal using a magnitude of the received signal, and for performing a sampling of a received data signal from the received signal using the separated clock signal to output the received data signal; a shift register for sequentially shifting and outputting a start pulse; a data latch for sequentially storing and outputting in parallel an image data included in the received according to a signal being output from the shift register; and a DAC for converting the image data from the data latch to an analog signal and outputting the analog signal.

In accordance with third aspect of the present invention, there is provided a display comprising a timing controller, a plurality of column driver integrated circuits, at least one row driving integrated circuit and a display panel, wherein the timing controller comprises a first receiving unit for receiving an image data; a buffer memory for temporarily storing and outputting the received image data; a timing controller circuit for generating a transmission clock signal; and a transmitter for receiving a transmission data signal including the image data output by the buffer memory and the transmission clock signal and for transmitting a transmission signal wherein the transmission clock signal is embedded between the transmission data signal to have a different signal magnitude to the plurality of the column driver integrated circuits, and wherein each of the plurality of the column driver integrated circuits comprises a second receiving unit for separating a clock signal embedded between received data signals using a magnitude of a signal received from the timing controller, and for performing a sampling of the received data signal using the separated clock signal; a shift register for sequentially shifting and outputting a start pulse; a data latch for sequentially storing and outputting in parallel an image data included in the received data signal according to a signal being output from the shift register; and a DAC for converting the image data from the data latch to an analog signal and outputting the analog signal.

Advantageous Effects

As described above, in accordance with the display, the timing controller and the column driver integrated circuit, the number of the signal lines are remarkably reduced, the EMI is also reduced and the accurate sampling is possible using the restored clock as well.

In addition, the display, the timing controller and the column driver integrated circuit reduces the signal line of the start pulse.

BRIEF DESCRIPTION OF THE DRAWINGS

FIG. 1 is a schematic diagram illustrating an embodiment of a conventional RSDS (Reduced Swing Differential Signaling).

FIG. 2 is a schematic diagram illustrating an embodiment of a conventional mini-LVDS (Low Voltage Differential Signaling).

FIG. 3 is a schematic diagram illustrating an embodiment of a conventional PPDS (Point-to-Point Differential Signaling).

FIG. 4 is a schematic diagram illustrating a method for receiving a clock signal in series from a neighboring column driver integrated circuit in the RSDS in series wherein the column driver integrated circuit is configured to have a chain structure.

FIG. 5 is a diagram illustrating a structure of a clock embedded intra-panel display in accordance with a first embodiment of the present invention.

FIG. 6 is a diagram illustrating only a transmission structure of a clock and a data between a timing controller and column driver integrated circuits of FIG. 5 for convenience of comprehension.

FIGS. 7 through 10 is diagrams illustrating examples of a multi-level signaling that can be used for an interface between the timing controller and the column driver integrated circuits of FIG. 5.

FIG. 11 is a diagram illustrating a structure of a clock embedded intra-panel display in accordance with a second embodiment of the present invention.

FIG. 12 is a diagram illustrating only a transmission structure of a clock and a data between a timing controller and column driver integrated circuits of FIG. 11 for convenience of comprehension.

FIG. 13 is a diagram illustrating an example of a timing controller that can be used for the display of FIG. 5 or FIG. 11.

FIG. 14 is a diagram illustrating an example of a column driver integrated circuit that can be used for the display of FIG. 5 or FIG. 11.

FIG. 15 is a diagram illustrating another example of a timing controller that can be used for the display of FIG. 5 or FIG. 11.

FIG. 16 is a diagram illustrating another example of a column driver integrated circuit that can be used for the display of FIG. 5 or FIG. 11.

10: RSDS timing controller
11: mini-LVDS timing controller
12, 13: PPDS timing controller
14, 15: timing controller used for clock embedded multi-level signaling method
20: RSDS column driver IC
21: mini-LVDS column driver IC
22, 23: PPDS column driver IC
24, 25: column driver integrated circuit used for clock embedded multi-level signaling method
30: row driving IC
40: display panel
51, 71: receiving unit of timing controller
52, 72: buffer memory
53, 73: timing controller circuit
54, 74: transmitter
55, 75: demultiplexer
56, 76: serial converter
57, 77: driving unit
61, 81: receiving unit of column driver IC
62, 82: shift register
63, 83: data latch
64, 84: DAC
65, 85: reference voltage generator
66, 86: multi-level detector
67, 87: clock restoring circuit
68, 88: sampler
69, 89: data aligning unit

BEST MODE FOR CARRYING OUT THE INVENTION

The present invention will now be described in detail with reference to the accompanied drawings. The interpretations of the terms and wordings used in Description and Claims should not be limited to common or literal meanings. The interpretation should be made to meet the meanings and concepts of the present invention based on the principle that the inventor or inventors may define the concept of the terms so as to best describe the invention thereof. Therefore, while the present invention has been particularly shown and described with reference to the preferred embodiment thereof, it will be understood by those skilled in the art that various changes in form and details may be effected therein without departing from the spirit and scope of the invention as defined by the appended claims.

In accordance with the present invention, a conventional multi-level signaling method is applied so as to provide a novel coding method wherein a clock signal information is embedded between data signals without and instead of a separate clock signal line, thereby resolving problems of conventional technologies such an impedance mismatching die to a multi-drop of a data line and a clock line and a resulting EMI.

In addition, in accordance with the present invention, the clock signal component can facilely extracted from the clock signal embedded in the data signal line using a multi-level detection method, and the clock signal component is only one-tenths of a frequency necessary for sampling of an actual data. Therefore, this plays a major role in reducing EMI of an entire system since the frequency is small, and a relative jitter or skew problem generated when the data signal and the clock signal are separate can be prevented to perform a stable operation in a high speed.

FIG. 5 is a diagram illustrating a structure of a clock embedded intra-panel display in accordance with a first embodiment of the present invention, and FIG. 6 is a diagram illustrating only a transmission structure of a clock and a data between a timing controller and column driver integrated circuits of FIG. 5 for convenience of comprehension. Referring to FIGS. 5 and 6, a display comprises a timing controller 14, a plurality of column driver integrated circuits 24, a plurality of row driver integrated circuits 30 and a display panel 40. A driving apparatus for the display panel 40 comprises the timing controller 14, the plurality of column driver integrated circuits 24 and the plurality of row driver integrated circuits 3).

The display panel 40 serves as a part for displaying an image according to a scanning signal and a data signal and may be selected from various display panels such as a LCD panel, a PDP panel and an OELD panel. The plurality of row driver integrated circuits 30 apply scan signals S1 through Sn to the display panel 40, and the plurality of column driver integrated circuits 24 applies data signals D1 through Dn to the display panel 40. The timing controller 14 transmits DATA to the plurality of column driver integrated circuits 24, and applies clocks CLK and CLK_R and start pulses SP and SP_R to the plurality of column driver integrated circuits 24 and the plurality of row driver integrated circuits 30. DATA transmitted from the timing controller 14 to the plurality of column driver integrated circuits 24 may comprises only an image data that is to be displayed on the display panel 40 or the image data and a control signal.

Contrary to the conventional technology, in accordance with the first embodiment of the present invention, only one pair of differential pair is used to transmit the clock CLK and the data signal DATA from the timing controller 14 to the column driver integrated circuit 24. The clock signal CLK is embedded between the data signal DATA to have a different signal magnitude at the timing controller 14 which is a transmitting terminal and transmitted. The clock signal CLK is distinguished from the data signal DATA using the magnitude of a received signal at the column driver integrated circuit 24 which is a receiving terminal.

FIG. 7 is a diagram illustrating an example of a multi-level signaling that can be used for an interface between the timing controller and the column driver integrated circuits of FIG. 5. Referring to FIGS. 5 through 7, the timing controller 14 converts the data to a signal having a smaller voltage than that of a predetermined reference voltage, a clock to a signal having a larger voltage than that of the predetermined reference voltage, and embeds the converted clock signal between the converted data signal to multiplex and then transmits. In addition, values of the data signals can be obtained at the column driver integrated circuit 24 which is the receiving terminal by a differential signal processing well-known in the art, and the clock signal is distinguished using Vrefh and Vrefl. That is, when an absolute value of difference between two input signals $|V_{in,p}-V_{in,n}|$ is smaller than a magnitude of the reference signal $|V_{refh}-V_{refl}|$, the two input signals are processed as the data signal. Therefore, when Vin,p is larger than Vin,n, the data values is set to 1 and when Vin,p is smaller than Vin,n, the data values is set to 0. When the absolute value of difference between the two input signals is larger than the magnitude of the reference signal ($|V_{in,p}-V_{in,n}|>|V_{refh}-V_{refl}|$), the two input signals are recognized as the clock.

As shown in the figures, since a frequency of an actually embedded clock is lower than a transmission speed of the data, the receiving terminal generates a clock signal having the same speed as that of the data using a PLL (not shown), and the data is sampled using the same. In an aspect of an EMI of the system, the most important f actor is the clock signal, and a magnitude of the EMI is known to be proportional to a magnitude and a frequency of the clock signal. Therefore, in accordance with the present invention, the frequency of the clock may be reduced to 1/10 or 1/20 of the conventional PPDS system, thereby remarkably reducing EMI.

In addition, when the clock is restored from the data and the clock signal configuration shown in the figures, the clock is restored in a naturally synchronized state with the data. Therefore, when a sampling is performed using the restored clock, it is advantageous in that the data sampling may be performed more accurately compared to the conventional LVDS, mini-LVDS and PPDS.

Moreover, as shown in the figures, while the number of combinations of signals that can actually be represented is four, the desired signals are two data signals and one click signal. Therefore, when an absolute value of difference between two input signals $|V_{in,p}-V_{in,n}|$ is larger than a magnitude of the reference signal $|V_{refh}-V_{refl}|$, the clock signal is unconditionally generated while a separate control signal or an image data may be transmitted simultaneously using sign of the two signals. When the sign is positive, it is recognized that 1 is applied, and when the sign is negative, it is recognized that 0 is applied.

FIG. 8 is a diagram illustrating another example of a multi-level signaling that can be used for an interface between the timing controller and the column driver integrated circuits of FIG. 5.

Referring to FIGS. 5, 6 and 8, the timing controller 14 converts the data to a signal having a larger voltage than that of a predetermined reference voltage, a clock to a signal having a smaller voltage than that of the predetermined reference voltage, and embeds the converted clock signal between the converted data signal to multiplex and then transmits. In addition, the column driver integrated circuit 24 which is a receiving terminal restores a received signal to the data when a voltage of the received signal is larger than that of a reference voltage and to the clock when the voltage of the received signal is smaller than that of the reference voltage.

As shown in the figures, since the clock signal does not have a concept such as 1 and 0 contrary to the data, a three multi-level is sufficient for the multi-level signaling. That is, when an absolute value of difference between two input signals |Vin,p−Vin,n| is larger than a magnitude of the reference signal |Vrefh−Vrefl|, the two input signals are recognized as the data signal, and the data is recognized as 1 or 0 according to a sign of the data signal. On the contrary, when an absolute value of difference between two input signals |Vin,p−Vin,n| is smaller than a magnitude of the reference signal |Vrefh−Vrefl|, the two input signals are recognized as the clock signal. Therefore, contrary to the method of FIG. 7 which requires 3ΔVx (ΔVx refers to a noise margin) voltage operation die to requirement of four multi-level, the method of FIG. 8 may be operated at a low voltage of 2ΔVx since three multi-levels are sufficient for the method of FIG. 8.

FIG. 9 is a diagram illustrating yet another example of a multi-level signaling that can be used for an interface between the timing controller and the column driver integrated circuits of FIG. 5.

In case of examples shown in FIGS. 7 and 8, although the clock signal is transmitted with the data, a clock restoring circuit consisting of a DLL, a PLL or the like is required at the receiving terminal as the clock signal does not exist for every data. A column driver integrated circuit of a large LCD is not affected by an increase in an area or a current due to DLL and the like. However, in case of a column driver integrated circuit of a small LCD, these may be problematic. Moreover, when the a transmission speed of the data is not very high, it is advantageous to configure the clock restoring circuit to be simple by transmitting the clock with every data.

The method shown in FIG. 9 is to resolve these problems. Although the method shown in FIG. 9 is similar to FIGS. 7 and 8 in the aspect of multi-level, it differs in that the clock signal is transmitted during a period corresponding to one half of the data period. When an absolute value of difference between two input signals |Vin,p−Vin,n| is larger than a magnitude of the reference signal |Vrefh−Vrefl|, the two input signals are recognized as the data signal, and the data is recognized as 1 or 0 according to a sign of the data signal. On the contrary, when an absolute value of difference between two input signals |Vin,p−Vin,n| is smaller than a magnitude of the reference signal |Vrefh−Vrefl|, the two input signals are unconditionally recognized as the clock signal.

As shown in the restored data and clock signal, the clock signal is positioned in a middle of each data transition period. The object of the clock restoring circuit is to place the clock at a most ideal position for sampling, i.e. in the middle of the data transition period, and it is obvious that the signal configuration of the present invention satisfies this. That is, the period of the data signal is halved while the length of the clock signal is configured to be identical to that of the data so that the clock signal is restored for each of the data at the receiving terminal. Through such process, the received data signal can be restored by a simple sampling circuit.

In accordance with the structure shown in FIG. 9, a sign of the received data is changed only when the received data is beyond a threshold value. That is, the value is changed according to the sign of the data only when an absolute value of a difference of two input signals |Vin,p−Vin,n| is larger than a magnitude of the reference signal |Vrefh−Vrefl|.

Contrary to this, two configurations are possible for the clock. Firstly, similar to the data, in case a polarity is changed only when an absolute value of a difference of two input signals |Vin,p−Vin,n| is smaller than a magnitude of the reference signal |Vrefh−Vrefl|, the data may be sampled at both a rising edge and a falling edge of the clock signal. Secondly, contrary to the above case, when case of the absolute value of the difference of the two input signals |Vin,p−Vin,n| being larger than a magnitude of the reference signal |Vrefh−Vrefl| and case of the absolute value of the difference of the two input signals |Vin,p−Vin,n| being smaller than a magnitude of the reference signal |Vrefh−Vrefl| are regarded as a transition period of the clock, the data is sampled at the rising edge of the clock signal as shown in FIG. 9.

Although description has been focused on a case of the clock signal being smaller than the data signal referring to FIG. 9, embedding the clock signal to each of the data signal may be applied when the magnitude of the clock signal is larger than that of the data signal, which can be facilely understood by a person skilled in the art. Therefore, a detailed description regarding this matter is omitted.

FIG. 10 is a diagram illustrating yet another example of a multi-level signaling that can be used for an interface between the timing controller and the column driver integrated circuits of FIG. 5.

Referring to FIG. 10, a polarity of the clock signal follows that of a previous data. That is, a data n-1 and the clock have the same polarity, and a tail bit of the clock is added to additionally generate a signal of a dummy data identical to the previous data signal (data n-1).

A sufficient rising time and falling time can be obtained through the dummy data. The dummy data is added to prevent the clock from being speeded up or delayed depending on a form of the previous data in case of FIG. 7. Therefore, in such case, because a possibility of generation of a jitter due to a slew rate between a transition of the data and a transition which is recognized as the clock signal is waived, it is advantageous in that a stable operation is secured in high speed transmission.

That is, while a position of a zero-crossing for generating the clock signal is dependent on a value of the previous data in case of FIG. 7, it is advantageous in that zero-pattern dependent jitter is not generated in case of FIG. 10.

Mode for the Invention

FIG. 11 is a diagram illustrating a structure of a clock embedded intra-panel display in accordance with a second embodiment of the present invention, and FIG. 12 is a diagram illustrating only a transmission structure of a clock and a data between a timing controller and column driver integrated circuits of FIG. 11 for convenience of comprehension.

Comparing the first embodiment and the second embodiment, the second embodiment employs a point-to-couple scheme while the first embodiment point-to-point scheme. Since the second embodiment is identical to the first embodiment except that the second embodiment employs the point-to-couple scheme, the multi-level signaling method that may be used for an interface between the timing controller and the column driver integrated circuit described referring to FIGS. 7 through 10 may be applied to the second embodiment. However, while one differential pair is connected to one column driver integrated circuit in case of the first embodiment, one differential pair is connected to two column driver integrated circuits 25 in case of the second embodiment. Therefore, an amount of data transmitted through the differential pair in case of the second embodiment is increased to twice as much as an amount in case of the first embodiment.

The reason a signal line of a start pulse SP transmitted from a timing controllers 14 and 15 to a column driver integrated circuits 24 and 25 is denoted in dotted line in FIGS. 5 and 11 is that the signal line of the start pulse SP is not used in some cases. Specifically, the signal line of the start pulse SP is necessary when only a clock signal CLK and an image data are transmitted through the differential pair while the signal line of the start pulse SP is necessary when the clock signal CLK, the image data and a control signal including the start pulse SP are transmitted through differential pair. In this case, the control signal may be included in a data signal DATA when being transmitted. In addition, when a magnitude of the clock signal is larger than that of the data signal, the control signal may be transmitted using a polarity of the clock signal. For example, of data signals corresponding to a predetermined row line, a clock signal positioned prior to a data transmitted to the column driver integrated circuit for the first time may have a polarity corresponding to 1, and other clock signals may have a polarity corresponding to 0.

FIG. 13 is a diagram illustrating an example of a timing controller that can be used for the display of FIG. 5 or FIG. 11. In accordance with the example, a case where the start pulse is transmitted through a signal line separate from the differential pair is exemplified. Referring to FIG. 13, the timing controller comprises a receiving unit 51, a buffer memory 52, a timing controller circuit 53 and a transmitter 54.

The receiving unit 51 converts an image data signal and a received control signal being input to the timing controller to a TTL (transistor-transistor logic) signal. The received control signal may be a start pulse, for example. The received signal being input to the timing controller is not limited to a signal of an LVDS type as shown in figure, but may be a signal of a TMDS (transition minimized differential signaling) type or other types. The TTL signal refers to a signal converted to digital, and has a large voltage magnitude contrary to the LVDS having a small magnitude of 0.35V.

The buffer memory 52 temporarily stores and outputs the image data converted to the TTL signal.

The timing controller circuit 53 receives a control signal converted to the TTL signal and generates a start pulse SP_R and a clock signal CLK_R transmitted to a row driving integrated circuit. The timing controller circuit 53 also generates the start signal SP to be transmitted to the column driver integrated circuit, and a clock to be used in the transmitter 54.

The transmitter 54 receives the image data being output from the buffer memory 52 and the clock signal being output from the timing controller circuit 53, and outputs the clock signal CLK and a data signal DATA to be transmitted to each column driver integrated circuit. The clock signal CLK and the data signal DATA are transmitted through the differential pair for each column driver integrated circuit, and the clock signal CLK is embedded between the data signal DATA to have a signal magnitude different from that of the data signal DATA. The transmitter 54 may embed the clock signal into each transmission data signals or may embed the transmission clock signal into every N transmission data signals (where N is an integer larger than 1). In addition, the transmitter 54 may transmit by setting a magnitude of the clock signal larger than that of the data signal or by setting the magnitude of the clock signal smaller than that of the data signal. When the magnitude of the clock signal is set to be larger than that of the data signal, the transmitter 54 may set a polarity of the embedded clock signal to be identical to that of the data signal immediately prior to the embedded clock signal, and inserts a dummy signal having a polarity identical to the data signal which is immediately prior to the embedded clock signal immediately after the embedded clock signal to prevent a jitter daring a high speed transmission. In addition, when the magnitude of the clock signal is set to be larger than that of the data signal, the data signal may be transmitted using the polarity of the clock signal. The transmitter 54 comprises a demultiplexer 55, a serial converter 56 and a driving unit 57.

The demultiplexer 55 transmits the image data being output from the buffer memory 52 to the serial converter 56 by separating the image data into data for each column driver integrated circuit. When a plurality of the column driver integrated circuits are connected to a single differential pair, the demultiplexer 55 transmits the image data to the serial converter 56 by separating the image data into data for each column driver integrated circuit. When two column driver integrated circuits are connected to the single differential pair as shown FIG. 11, the demultiplexer 55 transmits the image data corresponding to the two column driver integrated circuits to a single serial converter 56.

The serial converter 56 sequentially outputs a clock bit and the image data being output from the demultiplexer 55 to the driving unit 57. For example, when a clock tail shown in FIG. 10 is used, the serial converter 56 outputs a DATAn-1, the clock bit having the polarity identical to that of the DATAn-1, a clock tail bit (dummy bit) having the polarity identical to that of the DATAn-1, and a DATA 0.

When a single clock signal is embedded for each image data corresponding to a single pixel, a depth of each of RGB is 8 bit, and the clock tail is used as shown in FIG. 10, a data being output from the serial converter 56 which includes the clock bit, clock tail and 24 bits of image data, 26 bits in total, is transmitted to the driving unit 57 per clock. In addition, when the clock tail bit is not used, a signal including the clock bit and 24 bits of image data, 25 bits in total, may be transmitted to the driving unit 57 for every clock, and when the data signal is transmitted using the polarity of the clock signal, a signal of 24 bits may be transmitted to the driving unit 57 for every clock because a separate clock bit is not required. In addition, the serial converter 56 may dispose the clock bit between every data bit so that the clock is transmitted for every data as shown in FIG. 9.

The driving unit 57 converts the signal sequentially being output from the serial converter 56 to a differential signal to be output wherein the clock signal and the data signal have different signal magnitudes. As described above, when a signal including the clock bit, clock tail and 24 bits of image data, 26 bits in total, is received, a signal of the clock bit is converted to have a different magnitude from the clock tail and the image data, and when a signal including the clock bit and 24 bits of image data, 25 bits in total, is received, the signal of the clock bit is converted to have a different magnitude from the image data. In addition, as described above, when the signal of 24 bits which does not include the separate clock bit is received, the data signal in a position corresponding to the clock is converted to have a magnitude different from that of other image data signal. The driving unit 57 may convert clock signal to have a magnitude larger than that of the data signal, or may convert clock signal to have a magnitude smaller than that of the data signal.

FIG. 14 is a diagram illustrating an example of a column driver integrated circuit that can be used for the display of FIG. 5 or FIG. 11. In accordance with the example, a case where the start pulse is transmitted through a signal line separate from the differential pair is exemplified. Referring to FIG. 14, the column driver integrated circuit comprises a receiving unit 61, a shift register 62, data latch 63 and a DAC (digital-to-analog converter) 64.

The receiving unit 61 restores the data signal DATA and the clock signal CLK from the signal transmitted through the single differential pair. Since the clock signal CLK is transmitted by being embedded between the data signal DATA to have a different magnitude, whether the transmitted signal is the clock signal CLK or the data signal DATA is determined using the magnitude of the signal. Thereafter, the receiving unit 61 performs a sampling of the received data signal DATA using the restored clock signal CLK. When the timing controller embeds the clock signal CLK for each data signal DATA for transmission, the clock signal CLK may be used for the sampling of the data signal as is without changing a frequency of the clock signal CLK. However, when the timing controller embeds the clock signal CLK for a plurality of the data signal DATA for transmission, a signal should be generated from the clock signal CLK using a PLL or a DLL and the sampling is then performed using the signal. The receiving unit 61 comprises a reference voltage generator 65, a multi-level detector 66 and a sampler 68. In addition, the receiving unit 61 may further comprise a clock restoring circuit 67 and a data aligning unit 69.

The reference voltage generator 65 generates and outputs differential reference signals Vrefh and Vrefl. The multi-level detector 66 separates the clock signal CLK and the data signal DATA from the received signal by comparing a magnitude of the received signal with reference voltage Vrefh and Vrefl. In case the timing controller embeds the clock signal to have a smaller magnitude than the data signal for transmission, the received signal is recognized as a data when an absolute value of the received differential voltage $|V_{in,p}-V_{in,n}|$ is larger than a difference of the reference voltage $|V_{refh}-V_{refl}|$, and the received signal is recognized as a clock when the absolute value of the received differential voltage $|V_{in,p}-V_{in,n}|$ is smaller than the difference of the reference voltage $|V_{refh}-V_{refl}|$. In case the timing controller embeds the clock signal to have a larger magnitude than the data signal for transmission, the received signal is recognized as a data when an absolute value of the received differential voltage $|V_{in,p}-V_{in,n}|$ is smaller than a difference of the reference voltage $|V_{refh}-V_{refl}|$, and the received signal is recognized as a clock when the absolute value of the received differential voltage $|V_{in,p}-V_{in,n}|$ is larger than the difference of the reference voltage $|V_{refh}-V_{refl}|$.

The clock restoring circuit 67 generates a clock Rclk used for the sampling of the data signal from the received clock signal CLK. The clock restoring circuit 67 may be, for example, a PLL (phase locked loop) or a DLL (delay locked loop), and generate the clock Rclk having a high frequency used for the sampling of the data signal from the received clock signal CLK having a low frequency. When the frequency of the received clock sign CLK is identical to that of the data signal, the receiving unit 61 is not required to include the clock restoring circuit 67, and in this case, the clock signal CLK being output from the multi-level detector 66 is directly input to the sampler 68.

The sampler 68 performs a sampling of the data Rdata to be output using the clock Rclk used for the sampling. In addition, the sampler 68 may convert the sampled data to a parallel data. When each of R, G, B has a depth of 8 bits, parallel data of 24 bits may be output.

The data aligning unit 69 is necessary when the parallel data is not aligned to time so that an instant at which the parallel data is changed concurs.

The shift register 62 sequentially shifts the received start pulse SP to be output.

The data latch 63 sequentially stores the image data being output from the receiving unit according to a signal from the shift register 62, and then outputs the image data in parallel. For example, the data latch 63 sequentially stores a data corresponding to a portion of a single row line and then outputs the data in parallel.

The DAC 64 converts a digital signal being output by the data latch to an analog signal.

The above-described shift register 62, data latch 63 and DAC 64 have configurations similar to the case when the conventional RSDS is used. However, while the column driver integrated circuit employing the conventional RSDS has an operating frequency of a pixel frequency f, the column driver integrated circuit in accordance with the present invention have an lower operating frequency of f/N (where N is the number of the column driver integrated circuit). This facilitates an application of a cyclic DAC.

FIG. 15 is a diagram illustrating another example of a timing controller that can be used for the display of FIG. 5 or FIG. 11. The example exemplifies a case where the start pulse is transmitted through the differential pair. The timing controller of FIG. 15 is similar to that of FIG. 13 except that the start pulse is transmitted through the differential pair. Therefore, the description will be focused on the difference.

Referring to FIG. 15, the timing controller comprises a receiving unit 71, a buffer memory 72, a timing controller circuit 73 and a transmitter 74. The timing controller circuit 73 receives a reception control signal converted to a TTL signal to generate a start pulse SP_R and a clock signal CLK_R which are transmitted to a row driving integrated circuit. The timing controller circuit 73 also generates signals corresponding to a start pulse SP and a clock signal CLK which are transmitted to a column driving integrated circuit.

The transmitter 74 receives an image data being output from the buffer memory 72 and the start pulse SP and the clock signal CLK being output from the timing controller circuit 73, and outputs a control signal including the start pulse SP, the clock signal CLK and a data signal DATA. The control signal, the clock signal CLK and the data signal DATA are transmitted through the single differential pair for each column driver integrated circuit. The clock signal CLK is embedded between the data signal DATA to have a different signal magnitude and the control signal is transmitted using a polarity of the clock signal CLK or as a part of the data signal DATA.

The transmitter 74 comprises a demultiplexer 75, a serial converter 76 a driving unit 77. The serial converter 76 sequentially outputs a clock bit, the image data being output from the demultiplexer 75, and the control signal including the start pulse to the driving unit 77. For example, when a clock tail similar to the clock tail shown in FIG. 10 is used, the serial converter 76 outputs an image DATAn-1, the clock bit having the polarity identical to that of the image DATAn-1, a clock tail bit (dummy bit) having the polarity identical to that of the image DATAn-1, and an image DATA 0. When a single clock signal is embedded for each image data corresponding to a single pixel, a depth of each of RGB is 8 bit, and the clock tail is used as shown in FIG. 10, a data being output from the serial converter 76 which includes the clock bit, clock tail, the control bit and 24 bits of image data, 27 bits in total, is transmitted to the driving unit 77 per clock. In addition, when the clock tail bit is not used, a signal including the clock bit, the control bit and 24 bits of image data, 26 bits in total, may be transmitted to the driving unit 77 for every clock, and when the control signal is transmitted using the polarity of the clock signal, a signal of 25 bits may be transmitted to the driving unit 77 for every clock.

As described above, when the signal including the clock bit, clock tail, the control bit and 24 bits of image data, 27 bits in total, is received, a signal of the clock bit is converted to have a different magnitude from the clock tail, the control bit and the image data, and when a signal including the clock bit, the control bit and 24 bits of image data, 26 bits in total, is received, the signal of the clock bit is converted to have a different magnitude from the control bit and the image data. In addition, as described above, when the control bit is transmitted using the polarity of the clock bit, the control bit is converted to have a different magnitude from the image data.

FIG. 16 is a diagram illustrating another example of a column driver integrated circuit that can be used for the display of FIG. 5 or FIG. 11. The example exemplifies the case where the start pulse is transmitted through the differential pair. The column driver integrated circuit of FIG. 16 is similar to that of FIG. 14 except that the start pulse is transmitted through the differential pair. Therefore, the description will be focused on the difference.

Referring to FIG. 16, the column driver integrated circuit comprises a receiving unit 81, a shift register 82, data latch 83 and a DAC (digital-to-analog converter) 84. The receiving unit 81 restores the data signal DATA and the clock signal CLK from the signal transmitted through the single differential pair. Since the control signal including the start pulse is also transmitted through the differential pair, the receiving unit 81 obtains and outputs the control signal from the polarity of the clock signal CLK or restores and outputs the control signal transmitted as a part of the data signal DATA.

The receiving unit 81 comprises a reference voltage generator 85, a multi-level detector 86 and a sampler 88. In addition, the receiving unit 81 may further comprise a clock restoring circuit 87 and a data aligning unit 89. The sampler 88 performs a sampling of the data signal Rdata and the control signal to be output using the clock Rclk used for the sampling. As described above, the control signal may be obtained form the polarity of the clock signal or the part of the data signal. The obtained control signal is transmitted to the shift register 82.

Since the timing controller and the column driver integrated circuit shown in FIGS. 15 and 16 transmits the control signal such as the start pulse as well as the image data and the clock signal through the differential pair, compared to the timing controller and the column driver integrated circuit shown in FIGS. 13 and 14, a signal line for the star pulse may not be used. Therefore, the wiring of a display may be simplified.

INDUSTRIAL APPLICABILITY

In accordance with the above description, the display panel of the present invention includes various display panels wherein the present invention may be used such as a TFT-LCD (TFT Liquid Crystal Display), a STN-LCD, a Ch-LCD, a FLCD (Ferroelectric Liquid Crystal Display), a PDP (Plasma Display Panel), an OELD (Organic Electro-Luminescence Display) and FED.

While the description of the present invention is focused on a configuration where a single differential pair is connected between the timing controller and the column driver integrated circuit, the scope of the present invention does not exclude a configuration where two or more differential pairs are connected between the timing controller and the column driver integrated circuit.

While the present invention has been particularly shown and described with reference to the preferred embodiment thereof and drawings, it will be understood by those skilled in the art that various changes in form and details may be effected therein without departing from the spirit and scope of the invention as defined by the appended claims.

The invention claimed is:

1. A column driver integrated circuit, comprising:

a receiving unit configured to receive, as a received signal, a data signal and a clock signal, wherein the clock signal is embedded within the data signal and has a different amplitude than the data signal, and to separate the clock signal from the data signal using amplitude difference of the received signal, and to perform sampling of the data signal from the received signal using the separated clock signal to output the data signal;

a data latch configured to sequentially store and output image data included in the data signal; and a DAC configured to convert the image data from the data latch to an analog signal and output the analog signal, wherein the amplitude of the clock signal is larger than the amplitude of the data signal, and wherein:

the magnitude of the data signal is smaller than a predetermined reference voltage corresponds to $|Vrefh-Vrefl|>|Vdoh-Vdol|$;

the magnitude of the clock signal is larger than the predetermined reference voltage corresponds to $|Vcoh-Vcol|>|Vrefh-Vrefl|$;

Vrefh is a maximum value of the reference voltage;

Vrefl is a minimum value of the reference voltage;

Vdoh is a maximum voltage of the data signal;

Vdol is a minimum voltage of the data signal;

Vcoh is a maximum voltage of the clock signal; and

Vcol is a minimum voltage of the clock signal.

2. The column driver integrated circuit in accordance with claim 1, wherein the receiving unit obtains a control signal using the received signal.

3. The column driver integrated circuit in accordance with claim 2, wherein the control signal comprises the start pulse.

4. The column driver integrated circuit in accordance with claim 2, wherein receiving unit obtains the control signal using a polarity of the separated clock signal.

5. The column driver integrated circuit in accordance with claim 2, wherein the receiving unit obtains the control signal from a portion of the data signal.

6. The column driver integrated circuit in accordance with claim 1, wherein the receiving unit separates the received signal as the separated clock signal when the amplitude of the received signal is larger than that of a reference voltage, and separates the received signal as the data signal when the amplitude of the received signal is smaller than that of the reference voltage.

7. The column driver integrated circuit in accordance with claim 1, wherein the receiving unit separates the received signal as the separated clock signal when the amplitude of the received signal is smaller than that of a reference voltage, and separates the received signal as the data signal when the amplitude of the received signal is larger than that of the reference voltage.

8. The column driver integrated circuit in accordance with claim 1, wherein the receiving unit comprises:

a reference voltage generator configured to generate a differential reference voltage;

a multi-level detector configured to separate the clock signal from the received signal according to a result obtained by comparing the amplitude of the received signal to the differential reference voltage;

a clock restoring circuit configured to generate a clock signal used for the sampling using the separated clock signal; and a sampler configured to output the data signal by sampling the data signal from the received signal using the clock signal used for the sampling.

9. The column driver integrated circuit in accordance with claim 1, wherein the data latch outputs the image data in parallel.

10. The column driver integrated circuit in accordance with claim 1, wherein the amplitude of the clock signal as embedded within the data signal to form the received signal is larger than the amplitude of the data signal that has the clock signal embedded therewithin.

11. The column driver integrated circuit in accordance with claim 1, wherein the clock signal is embedded within the data signal to be positioned in a middle of each data transition period of the data signal.

* * * * *